US011473024B2

(12) United States Patent
Coleman et al.

(10) Patent No.: US 11,473,024 B2
(45) Date of Patent: Oct. 18, 2022

(54) PROCESSING PYROLYSIS TAR PARTICULATES

(71) Applicant: ExxonMobil Chemical Patents Inc., Baytown, TX (US)

(72) Inventors: John S. Coleman, Houston, TX (US); Kendele S. Galvan, Houston, TX (US); John J. Monson, Bend, OR (US); Denise M. Burcham, Houston, TX (US); Kapil Kandel, Humble, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 86 days.

(21) Appl. No.: 17/045,416

(22) PCT Filed: Mar. 20, 2019

(86) PCT No.: PCT/US2019/023187

§ 371 (c)(1),
(2) Date: Oct. 5, 2020

(87) PCT Pub. No.: WO2019/203981

PCT Pub. Date: Oct. 24, 2019

(65) Prior Publication Data

US 2021/0179954 A1 Jun. 17, 2021

Related U.S. Application Data

(60) Provisional application No. 62/659,183, filed on Apr. 18, 2018.

(30) Foreign Application Priority Data

May 24, 2018 (EP) ..... 18174064

(51) Int. Cl.
*C10G 69/06* (2006.01)

(52) U.S. Cl.
CPC ..... *C10G 69/06* (2013.01); *C10G 2300/208* (2013.01); *C10G 2300/4081* (2013.01)

(58) Field of Classification Search
CPC ..... C10G 55/04; C10G 67/02; C10G 69/06
See application file for complete search history.

(56) References Cited

U.S. PATENT DOCUMENTS 8,288,600 B2 10/2012 Bartek et al.
2009/0163352 A1 6/2009 Powers et al.
(Continued)

*Primary Examiner* — Renee Robinson
(74) *Attorney, Agent, or Firm* — Exxonmobil Chemical Patents Inc.

(57) ABSTRACT

Systems and methods are provided for increasing the portion of a pyrolysis tar fraction that can be hydroprocessed by using a physical particle size reduction process on at least a portion of the pyrolysis tar fraction. The physical particle size reduction process can reduce the percentage of particles in the pyrolysis tar fraction that have a particle size of 75 μm or greater, or 50 μm or greater. It has been unexpectedly discovered that at least a portion of the particles having a size of 75 μm or less, or 50 μm or less, can be effectively hydroprocessed to form products of greater value while still reducing or minimizing the amount of fouling or plugging in a hydroprocessing catalyst bed. By increasing the number of particles having a size of 75 μm or less, or 50 μm or less, while selectively removing larger particles from the SCT fraction, a higher yield of hydrocarbon products can be achieved for a feed containing an SCT fraction. This can reduce or minimize the amount of particulates that are disposed of by incineration or another disposal method for fractions that have a lesser value.

21 Claims, 3 Drawing Sheets

(56) References Cited

U.S. PATENT DOCUMENTS

| | | | | |
|---|---|---|---|---|
| 2014/0197069 | A1* | 7/2014 | Mukherjee | B01J 19/245 422/187 |
| 2015/0344785 | A1 | 12/2015 | Soultanidis et al. | |
| 2015/0361359 | A1 | 12/2015 | Beech, Jr. | |
| 2016/0122667 | A1 | 5/2016 | Evans et al. | |
| 2018/0134965 | A1 | 5/2018 | Brown et al. | |

* cited by examiner

PROCESSING PYROLYSIS TAR PARTICULATES

CROSS-REFERENCE OF RELATED APPLICATIONS

Priority

This application is a National Phase Application claiming priority to P.C.T. Patent Application Serial No. PCT/US2019/023187 filed Mar. 20, 2019, which claims priority to and the benefit of U.S. Provisional Application No. 62/659,183, filed Apr. 18, 2018, and European Patent Application No. 18174064.8 which was filed May 24, 2018, the disclosures of which are incorporated herein by reference in their entireties.

FIELD

Systems and methods are provided for processing of stream cracker tar fractions that contain particulates.

BACKGROUND

Steam cracking, a type of pyrolysis, has long been used to crack various hydrocarbon feedstocks. Conventional steam cracking utilizes a pyrolysis furnace wherein the feedstock, typically comprising crude or a fraction thereof, optionally desalted, is heated sufficiently to cause thermal decomposition of the larger molecules. The potential products generated by steam cracking, depending on the conditions, can include light olefins (ethylene, propylene), steam cracked naphtha (SCN), and steam cracked gas oil (SCGO). The steam cracking process, however, also produces molecules that tend to combine to form high molecular weight materials known as steam cracked tar, hereinafter referred to as "SCT". In general, feedstocks containing higher boiling materials ("heavy feeds") tend to produce greater quantities of SCT.

SCT is among the least desirable of the products of pyrolysis since it finds few uses. Some difficulties with SCT can be related to the substantial number of particles present within a typical SCT stream. Other difficulties with SCT can be related to the low compatibility of SCT with other "virgin" products. "Virgin" products are those which have not undergone hydrocarbon conversion, e.g., those that are not the product of the fluidized catalytic cracking ("FCC") or steam cracking of distilled streams obtained a refinery pipestill located upstream of the cracker. At least one reason for such incompatibility is the presence of asphaltenes. Asphaltenes have a relatively large molecular weight and can precipitate out when blended in even insignificant amounts into other materials, such as fuel oil streams. The various types of particles and/or asphaltenes within SCT can contribute to substantial fouling and/or plugging of catalyst beds when attempting to process SCT. What is needed are systems and/or methods for SCT processing to form higher value products, such as hydroprocessed SCT, with a reduced or minimized amount of fouling in catalyst beds of the processing unit(s). Additionally, it would be desirable to increase the proportion of an SCT fraction that can be processed to form the higher value products.

More generally, steam cracking represents a type of pyrolysis process. Besides steam cracking, other types of pyrolysis processes can form viscous, high-molecular weight materials, typically referred to as "pyrolysis tar". It is further desired to increase the proportion of various types of pyrolysis tars that can be processed to form higher value products.

U.S. Pat. No. 9,637,694 and U.S. Patent Application Publication No. 2015/0344785 provide examples of processes for upgrading of pyrolysis tar (such as SCT) using solvent-assisted hydroprocessing. U.S. Pat. No. 9,637,694 notes the presence of particulates in pyrolysis tar, and that such particulates can be removed prior to upgrading the pyrolysis tar.

U.S. Patent Application Publication No. 2009/0163352 describes methods for recovery of catalyst metals after slurry hydroprocessing. After performing slurry hydroprocessing, a heavy fraction or bottoms fraction containing a substantial portion of the catalyst from the slurry hydroprocessing can be passed into a coker. The coke formed during the coking reaction can include the catalyst metals. The resulting coke can be ground to a desired particle size prior to treating the coke in an effort to recover the metals. No mention is made of attempting to further hydroprocess the ground coke fines.

SUMMARY

In various aspects, systems and methods are provided for using mechanical size reduction processes to facilitate processing of pyrolysis tar fractions that include particles. A combination of separation processes, such as centrifugation, and mechanical or physical size reduction, such as grinding, ball milling, or ablation, can be used to reduce or minimize the content of particles within a feedstock having a particle size of 50 μm or greater, or 75 μm or greater. It has been discovered that hydroprocessing can be effective for removal of particles (such as coke particles) that have a size below 50 μm. By converting at least a portion of the particles having a size of greater than 50 μm to smaller particles prior to hydroprocessing, the product yield from hydroprocessing of a pyrolysis tar fraction can be increased and/or the volume of a waste stream containing particles from a pyrolysis tar feedstock can be reduced. In some aspects, a pyrolysis feed can be exposed to particle size reduction prior to performing the separation to remove larger particles. Alternatively an initial separation can be performed to form a (larger particle) solids rejection fraction, which is then exposed to a mechanical size reduction process. The effluent from the size reduction process can then be returned to the separation stage to allow for inclusion of any sufficiently small particles present into the input for the hydroprocessing stage. Depending on the aspect, from 5 wt. % to 50 wt. % of the particulates in the feed can be processed for incorporation into the desired hydroprocessed products.

DETAILED DESCRIPTION

Figure 1:
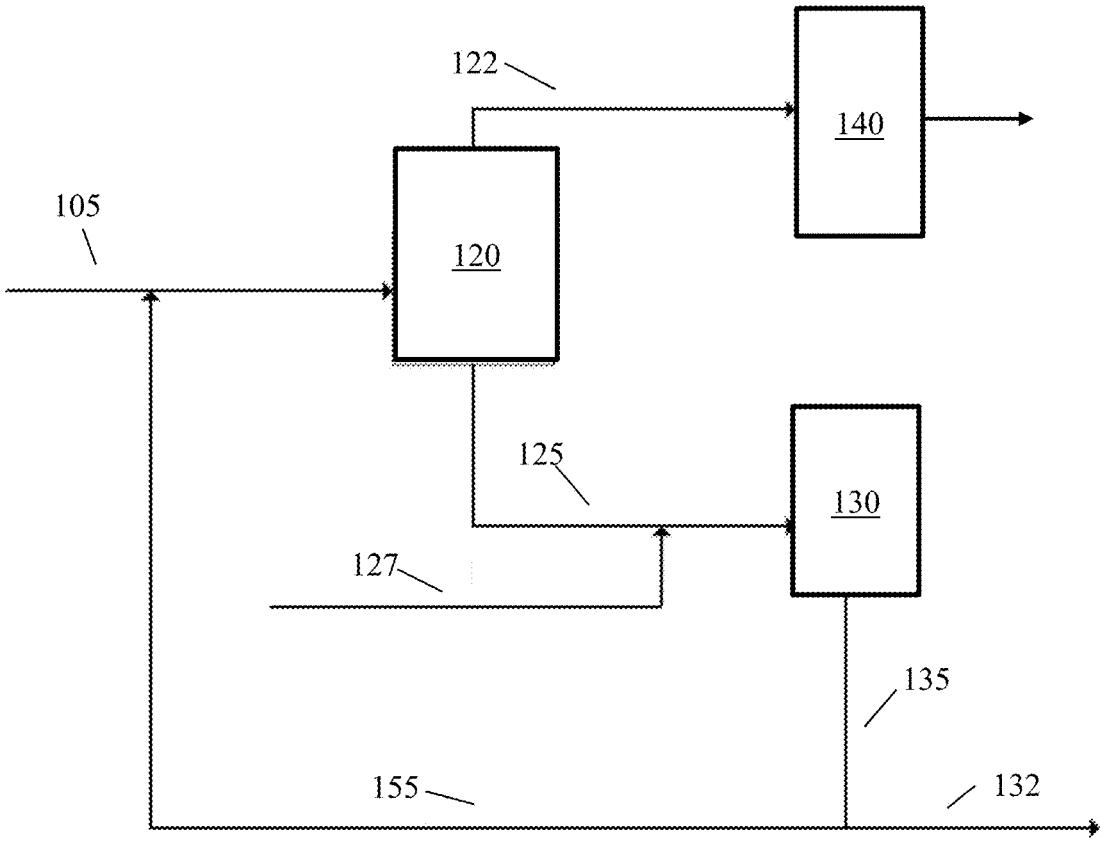
FIG. 1 schematically shows an example of a configuration for reducing the size of particles in a feed containing an SCT prior to solvent-assisted hydroprocessing.

In various aspects, systems and methods are provided for increasing the portion of a pyrolysis tar fraction that can be hydroprocessed by using a physical particle size reduction process on at least a portion of the pyrolysis tar fraction. The physical particle size reduction process can reduce the percentage of particles in the pyrolysis tar fraction that have a particle size of 75 μm or greater, or 50 μm or greater. It has been unexpectedly discovered that at least a portion of the particles having a size of 75 μm or less, or 50 μm or less, can be effectively hydroprocessed to form higher value products while still reducing or minimizing the amount of fouling or plugging in a hydroprocessing catalyst bed. By decreasing the number of particles having a size of 75 μm or less, or 50 μm or less, while selectively removing larger particles from the pyrolysis tar fraction, a higher yield of hydrocarbon products can be achieved for a feed containing a pyrolysis tar fraction. Depending on the aspect, from 5 wt. % to 50 wt. % of the particulates in the feed can be processed for incorporation into the desired hydroprocessed products. This can decrease or minimize the amount of particulates that are conducted away from the process for storage or further processing.

SCT and/or other pyrolysis tars typically contain particulate matter that ranges from oligomerized olefinic structures near the solubility point to hydrogen-reduced pyrolytic coke. It has been discovered that these particulates can be converted to a liquid product under hydroprocessing conditions in the presence of hydrogen. Although the initial particle size distribution of particles in a pyrolysis tar can include particles that are sufficiently large to lead to increased reactor fouling, small particulate sizes in the tar are able to penetrate into catalyst beds for conversion. By conditioning a portion of the larger particles, and then removing at least an additional portion of the remaining larger particles, the hydrocarbon product yield from SCT processing can be increased while maintaining reactor fouling or plugging at decreased or minimized levels in comparison with conventional SCT upgrading processes. For example, many of the particulates commonly identified in SCT are oligomeric in nature. These large oligomers (typically olefinic) border on the edge of solubility in SCT as their size increases. However, it has been discovered that these particulates can effectively be converted into a liquid product when subjected to suitable conversion/hydroprocessing conditions.

An example of a suitable process for conversion of small particulates into liquid products can be solvent-assisted hydroprocessing, such as conditions suitable for solvent-assisted tar conversion. Solvent-assisted hydroprocessing of a heavy feed, such as an SCT, can be beneficial for reducing the amount of fouling or plugging during hydroprocessing. The amount of fouling or plugging can be further reduced during solvent-assisted hydroprocessing by removing particles of larger than a target size, such as particles larger than about 75 μm, or larger than about 50 μm, or larger than about 25 μm. By converting at least a portion of such larger particles to particles below the size threshold, the benefits of solvent-assisted hydroprocessing on a pyrolysis tar fraction with low particle content can be realized while also improving the overall yield.

The physical particle size reduction process can be performed prior to or after separation of particles from a steam cracked tar (SCT) or other pyrolysis tar. In some aspects, a clarified feed fraction and a solids rejection fraction can be separated from a feed containing a pyrolysis tar. The solids rejection fraction can then be exposed to the physical particle size reduction process to form additional particles having a lower particle size. Those skilled in the art will appreciate that the term "fraction" in this sense means components separated from the feed, but is not limited to those separated by fractionation. A portion of the solids rejection fraction can then be recycled back to the input for the separation process. This can allow the recycled particles having a smaller particle size to be incorporated into the input stream for a hydroprocessing reactor. In other aspects, the entire feed (including the feed's pyrolysis tar, i.e., the "pyrolysis tar fraction" of the feed) can be exposed to the physical particle size reduction process. This can increase the percentage of small particles in the feed prior to separating a clarified feed fraction and a solids rejection fraction. This can increase the amount of feed that needs to be processed to form reduced size particles, but it can also have the advantage of providing a simplified configuration. When the separation is carried out continuously or semi-continuously, a clarified feed stream and a solids rejection stream can be conducted away from the separation.

In some aspects, the particulate matter can correspond to a mixture of particle types with a range of properties. For example, in addition to the oligomerized olefinic structures, a portion of the particles can correspond to pyrolytic coke. In some aspects, the particle of the pyrolytic coke can have a sufficiently different hardness from the oligomerized olefinic particles so that the oligomerized olefins can be selectively reduced in size. In such aspects, the amount of non-reactive particles having a particle size of 25 μm or less that are created during the particle size reduction can be reduced or minimized. This can reduce or minimize the need to perform further particle reduction on the resulting hydroprocessed effluent.

In this description, the particle size of particles in a hydrocarbon medium (e.g., a hydrocarbon liquid, such as a liquid fraction) can be characterized by laser diffraction. It is noted that particle size distributions can vary between types of equipment when performing laser diffraction for particle size characterization. In this discussion, particle size distributions were characterized using a Mastersizer from Malvern Instruments. If needed, the particle size distribution of a sample can be determined according to a suitable ASTM method, such as ASTM D4464.

The term "asphaltene" is well-known in the art and generally refers to the material obtainable from crude oil and having an initial boiling point above 1200° F. (i.e., 1200° F.+ or ~650° C.+ material) and which is substantially insoluble in straight chain alkanes such as hexane and heptanes, i.e., paraffinic solvents. Asphaltenes are high molecular weight, complex aromatic ring structures and may exist as colloidal dispersions. They are substantially soluble in aromatic solvents like xylene and toluene. Asphaltene content can be measured by various techniques known to those of skill in the art, e.g., ASTM D3279. In various aspects, SCT can have an n-heptane insoluble asphaltene content of at least about 5 wt. %, or at least about 10 wt. %, or at least about 15 wt. %, such as up to about 40 wt. %.

A method of characterizing the solubility properties of a substantially liquid hydrocarbon can correspond to the toluene equivalence (TE) of a fraction, based on the toluene equivalence test as described for example in U.S. Pat. No. 5,871,634, which is incorporated herein by reference with regard to the definition for toluene equivalence, solubility number (SBN), and insolubility number (IN).

Briefly, the determination of the insolubility Number and the Solubility Blending Number for a petroleum oil containing asphaltenes requires testing the solubility of the oil in test liquid mixtures at the minimum of two volume ratios of oil to test liquid mixture. The test liquid mixtures are prepared by mixing two liquids in various proportions. One liquid is nonpolar and a solvent for the asphaltenes (or asphaltene-like molecules) in the oil while the other liquid is nonpolar and a nonsolvent for the asphaltenes in the oil. Since asphaltenes are defined as being insoluble in n-heptane and soluble in toluene, it is most convenient to select the same n-heptane as the nonsolvent for the test liquid and toluene as the solvent for the test liquid. It is noted that other test nonsol vents and test solvents could be used. In this discussion, solubility number and insolubility number are defined based on use of n-heptane and toluene.

A convenient volume ratio of oil to test liquid mixture is selected for the first test, for instance, 1 ml. of oil to 5 ml. of test liquid mixture. Then various mixtures of the test liquid mixture are prepared by blending n-heptane and toluene in various known proportions. Each of these is mixed with the oil at the selected volume ratio of oil to test liquid mixture. Then it is determined for each of these if the asphaltenes are soluble or insoluble. Any convenient method might be used. One possibility is to observe a drop of the blend of test liquid mixture and oil between a glass slide and a glass cover slip using transmitted light with an optical microscope at a magnification of from 50 to 600×. If the asphaltenes (or asphaltene-like molecules) are in solution, few, if any, dark particles will be observed. If the asphaltenes are insoluble, many dark, usually brownish, particles, usually 0.5 to 10 microns in size, will be observed. Another possible method is to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oil will be relatively uniform in color. The results of blending oil with all of the test liquid mixtures are ordered according to increasing percent toluene in the test liquid mixture. The desired value will be between the minimum percent toluene that dissolves asphaltenes (or asphaltene-like molecules) and the maximum percent toluene that precipitates asphaltenes (or asphaltene-like molecules). More test liquid mixtures are prepared with percent toluene in between these limits, blended with oil at the selected oil to test liquid mixture volume ratio, and determined if the asphaltenes are soluble or insoluble. The desired value will be between the minimum percent toluene that dissolves asphaltenes and the maximum percent toluene that precipitates asphaltenes. This process is continued until the desired value is determined within the desired accuracy. Finally, the desired value is taken to be the mean of the minimum percent toluene that dissolves asphaltenes and the maximum percent toluene that precipitates asphaltenes. This is the first datum point, $T_1$, at the selected oil to test liquid mixture volume ratio, $R_1$. This test is called the toluene equivalence test.

The second datum point can be determined by the same process as the first datum point, only by selecting a different oil to test liquid mixture volume ratio. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase as the further apart the second datum point is from the first datum point, the preferred test liquid mixture for determining the second datum point is 0% toluene or 100% n-heptane. This test is called the heptane dilution test.

The Insolubility Number, $I_N$, is given by:

$$I_N = T_2 - \left[\frac{T_2 - T_1}{R_2 - R_1}\right]R_2 \tag{1}$$

and the Solubility Blending Number, SBN, is given hs $$S_{BN} = I_N\left[1 + \frac{1}{R_2}\right] - \frac{T_2}{R_2} \tag{2}$$

It is noted that additional procedures are available, such as those specified in U.S. Pat. No. 5,871,634, for determination of SBN for oil samples that do not contain asphaltenes.

Separation and Hydroprocessing of Particles from Pyrolysis Tar Fractions

Separation of larger particles from a tar feed (e.g., a pyrolysis tar feed such as SCT) can be performed using any convenient method. In some aspects, settling tanks can be used to preferentially remove larger particles that may be present in a feed including a SCT fraction and/or other pyrolysis tar fraction. In other aspects, a feed including a pyrolysis tar fraction (or a portion thereof) can be passed into one or more centrifuges for removal of larger particles. In still other aspects, filtration can be used for removal of particles that are larger than a desired size. For example, it may be beneficial to remove particles of roughly millimeter size using a filter prior to performing additional particle removal using settling and/or centrifugation. Depending on the aspect, separation of particles from a feed can be performed prior to and/or after performing a physical particle size reduction process on the feed.

Prior to performing a separation process to reduce the number of particles, a feedstock including a pyrolysis tar fraction (such as a SCT fraction) can include a wide range of particle amounts depending on the nature of the feed for the prior pyrolysis process. For some pyrolysis feeds, such as light hydrocarbon feeds for steam cracking, the resulting pyrolysis tar can include about 50 wppm or more of particles having a particle size of 50 μm or greater (or 75 μm or greater), or about 100 wppm or more, or about 250 wppm or more, or about 500 wppm or more, such as up to 5000 wppm or possibly still higher. For other types of pyrolysis feeds, such as feeds corresponding to partial or whole crudes, the resulting pyrolysis tar can include about 0.1 wt. % to about 3.0 wt. % of particles having a particle size of 50 μm or greater (or 75 μm or greater), or about 0.2 wt. % to about 2.0 wt. %.

In various aspects, after performing physical particle size reduction and performing a separation to remove larger particles, the resulting input fraction to solvent-assisted hydroprocessing can include an amount of particles with a particle size of 0.1 μm to 75 μm (or 0.1 μm to 50 μm) can be 10 wppm to 20,000 wppm. For example, the amount of particles in the feed having a particle size of 0.1 μm to 75 μm (or 0.1 μm to 50 μm) can be 50 wppm to 30000 wppm, or 100 wppm to 20000 wppm, or 50 wppm to 5000 wppm.

A combination of physical particle size reduction and separation can be used to modify the particle size distribution in the feed containing a pyrolysis tar fraction. After the combination of physical particle size reduction and separation to remove at least a portion of larger particles, a first effluent corresponding to a clarified feed fraction and a second effluent corresponding to a rejected solids fraction can be formed. The rejected solids fraction can include about 1 wt. % to about 25 wt. % of particles having a particle size of 25 μm or greater, or about 5 wt. % to about 25 wt. %, or about 10 wt. % to about 25 wt. %. Additionally or alternately, the rejected solids fraction can include 60 wt. % or more of the particles present in the input feed to the separation that have a particle size of 25 μm or more (or 50 μm or more, or 75 μm or more), or 70 wt. % or more, such as up to 100 wt. %. The clarified feed fraction can include 100 wppm or less of particles having a particle size of greater than 75 μm. Additionally or alternately, the clarified fraction can include about 100 wppm or more of particles having a particle size of 50 μm or greater (or 25 μm or greater), or about 200 wppm or more, or about 500 wppm or more, such as up to about 5000 wppm or more. Further additionally or alternately, the clarified feed fraction can include 100 wppm to 10000 wppm (or 2000 wppm to 5000 wppm) of particles having a particle size of 0.1 μm to 75 μm, or 0.1 μm to 50 μm.

After solvent-assisted hydroprocessing, the resulting hydroprocessed effluent can include 100 wppm or less of particles having a particle size of 0.1 μm to 75 μm (or 0.1 μm to 50 μm), or 50 wppm or less, or 25 wppm or less, such as down to 1 wppm or possibly still lower. Additionally or alternately, the amount of particles having a particle size of 0.1 μm to 75 μm (or 0.1 μm to 50 μm) in the hydroprocessed effluent can be 75 wt. % or less relative to the amount of particles having a particle size of 0.1 μm to 75 μm (or 0.1 μm to 50 μm) in the clarified feed fraction used as the input to hydroprocessing. It is noted that in some aspects, a portion of the particles can correspond to coke fines that substantially retain their size during solvent-assisted hydroprocessing. Thus, the hydroprocessed effluent can contain 1 wppm or more, or 100 wppm or more of particles having a particle size of 0.1 μm to 75 μm (0.1 μm to 50 μm) due to the presence of coke fines, such as up to 50 wppm or possibly still higher.

Separation Methods

In some aspects, separation of particles from a feed including a SCT fraction (and/or other pyrolysis tar fraction) can be improved by incorporating a solvent into the feed prior to the separation. Pyrolysis tar fractions can tend to have a relatively high viscosity at temperatures that are convenient for performing grinding or another particle size reduction process, such as temperatures of about 20° C. to about 100° C. Depending on the relative amount of pyrolysis tar in a feed versus lower viscosity fractions, it may be beneficial to add an aromatic solvent and/or utility fluid to a feed including a pyrolysis tar fraction prior to performing a separation. This can reduce the viscosity of a feed containing a SCT/pyrolysis tar fraction, which can potentially provide various benefits. For example, lowering the viscosity of a feed containing a pyrolysis tar fraction can increase the speed of separation of particles from the feed during processes such as settling or centrifugation. Addition of a solvent can also potentially facilitate flow of the feed containing a pyrolysis tar fraction through various types of process equipment, such as conduits, pumps, and/or filters. Suitable solvents can be similar to solvents and/or utility fluids that are suitable for performing solvent-assisted hydroprocessing, as described in more detail below. Additionally or alternately, suitable solvents can correspond to solvents that have a solubility number (SBN) of about 100 or more, or about 120 or more. Additionally or alternately, suitable solvents can correspond to solvents that include a substantial amount of 2+-ring aromatic compounds. After any optional mixing of a feed including a pyrolysis tar fraction with a solvent, the feed can be passed into one or more separation processes.

In some aspects, the separation of particles from a feed can be carried out in using one or more centrifuges, optionally in combination with other forms of separation. An example of a suitable type of centrifuge can be a decanter centrifuge. A decanter centrifuge can provide some of the benefits of a settling process with the benefits of a centrifuge-based separation. Decanter centrifuges, which combine a rotary action with a helical scroll-like device to move collected solids along and out of the centrifuge bowl, are well adapted to handling high solids input fractions such as (optionally solvent diluted) pyrolysis tars. Depending on conditions, solids contents up to 25 weight percent can be tolerated by this type of unit although in many cases, the input stream to the centrifuge can have 10 weight percent solids or less. The decanter centrifuge is capable of efficiently removing the liquids from the solids by the compacting action which takes place as the solids are progressively forced down the tapered portion of the rotating bowl towards the solids discharge port while the oil can be separately discharged from the opposite end of the bowl.

Additionally or alternately, in some aspects settling can provide a convenient method for removing larger particles from a feed. During a settling process, a feed can be held in a settling tank or other vessel for a period of time. This time period can be referred to as a settling time. The feed can be at a settling temperature during the settling time. Any convenient settling temperature can potentially be used. In some aspects, a temperature from about 20° C. to about 100° C. can be used, but higher temperatures can also potentially be suitable.

After the settling time, the particles can be concentrated in a lower portion of the settling tank. In some aspects, the clarified feed fraction can be removed from the upper portion of the settling tank while leaving the particle-enriched bottoms (i.e., the solids rejection fraction) in the tank. The settling process can be suitable for reducing the concentration of particles having a particle size of about 25 μm or greater from a feed including a SCT fraction and/or other pyrolysis tar fraction.

Additionally or alternately, in some aspects, physical filtration based on particle size can be used for separating large particles from a feed, such as particles having a particle size of 0.5 mm or more, or 1.0 mm or more, or 10 mm or more. This can correspond to passing a feed through a filter to form a permeate with a reduced particle content and a retentate enriched in particles. In some aspects, filtration of larger particles can be used as an initial separation stage prior to another separation method for separation of smaller particle sizes.

After performing a separation to form a solids rejection fraction and a clarified feed fraction, a portion of the solids rejection fraction can be recycled back to the beginning of the separation process. Another portion of the solids rejection fraction can be removed from the system. In some aspects, this "purge" portion of the solids rejection fraction can have a composition, for example, that is nominally 30-60 wt. % pyrolitic coke/polymers, with the balance corresponding to hydrocarbon that wets the surface of the coke. Recycling a portion (but only a portion) of the solids rejection fraction can allow some larger particles to be removed from the separation system while still allowing for some additional recovery of smaller particles that may have become entrained in the solids rejection fraction.

Optionally, a further separation can be performed on the solids rejection fraction using a hydrocyclone, a decanter centrifuge, and/or other centrifugal separator. A hydrocyclone separator can be beneficial for separating out smaller particles that become entrained in the solids rejection stream. In aspects where an additional hydrocyclone separator (or other additional separator) is used, the heavy fraction from the additional separator can be removed from the system while the lighter fraction(s) from the additional separator can be used, at least in part, as a recycle stream that is combined with the feed prior to entering the separation processes. Additionally or alternately, the lighter fraction from the additional separator can be combined with the clarified feed fraction prior to hydroprocessing of the clarified feed fraction. Optionally, in aspects where the separation to form the rejected solids fraction is performed prior to particle size reduction, a portion of the heavy fraction and/or a portion of the lighter fractions can also be recycled for combination with the rejected solids fraction prior to entering the particle size reduction process.

Particle Size Reduction—Physical Processes

Those skilled in the art will appreciate that physical processes for particle size reduction are typically carried out by applying a mechanical force. Examples of physical processes for particle size reduction can include, but are not limited to, grinding, ball milling, ablation in an ablation drum, and/or other mechanical size reduction processes. Physical process for particle size reduction can be in contrast to chemical processes for size reduction. For example, as described herein, at least a portion of sufficiently small particles in a SCT fraction (or other pyrolysis tar fraction) can be hydrotreated (such as under solvent-assisted hydrotreating conditions) to convert the small particles into liquid products. During solvent-assisted hydrotreating, a combination of elevated temperature, elevated pressure, the presence of chemical reagents, and/or the presence of catalysts are used to induce chemical reactions. The chemical reactions result in changes in chemical compositions that can then result in a reduction in particle size. By contrast, in some aspects the physical particle size reduction processes described herein can result in particles with roughly similar compositions (with possible exception of surface layers) both before and after the particle size reduction process.

After performing a physical particle size reduction process on a feed, the weight of particles having a particle size of 25 μm or more in the feed can be reduced. For example, the reduced particle size effluent can have a weight of particles having a particle size of 25 μm or more that is 85% or less relative to the weight of such particles in the input feed to the particle reduction process, or 75% or less, or 65% or less, or 50% or less, such as down to 10% or possibly still lower.

One option for reducing particle size can be to pass a SCT fraction through a grinding process. A variety of commercially available grinders are available and can potentially be suitable for reducing particle size.

Ball milling and ablation are other examples of suitable processes for reducing particle size. More generally, any convenient commercially available process for reducing the size of particles, such as coke fines, can be used.

In some aspects, during a physical particle size reduction process, an SCT (or mixture of SCTs) can be mixed with a solvent and/or utility fluid in an amount similar to an amount used for subsequent SCT hydroprocessing. This can be suitable, for example, in aspects where particle size reduction is performed prior to the separation to form a clarified feed fraction and a solids rejection fraction. In aspects where a separation is performed prior to particle size reduction, the feed to the separation can correspond to a pyrolysis tar fraction plus a solvent. After separation, a majority of the pyrolysis tar plus solvent can be separated into the clarified feed fraction. The remaining rejected solids fraction may not have desirable flow and/or viscosity properties for performing particle size reduction. Thus, it may be desirable to add additional solvent to the rejected solids fraction prior to particle size reduction. When solvent is present, the solvent can correspond to 20 wt. % to 60 wt. % of the combined solvent plus pyrolysis tar fraction, or 20 wt. % to 50 wt. %, or 30 wt. % to 60 wt. %. Optionally, additional solvent can be added after grinding to facilitate density-based separation of the particles from the solvent plus pyrolysis tar fraction.

Examples of Configurations for Particle Size Reduction

FIG. 1 shows an example of a configuration for performing particle size reduction on a rejected solids fraction derived from a SCT feed. More generally, a configuration similar to FIG. 1 can be used for performing particle size reduction on a rejected solids fraction derived from a pyrolysis tar feed.

In FIG. 1, a feed 105 including steam cracked tar (SCT) and a solvent, such as a utility fluid, is passed into centrifuge 120. In other aspects, a settling tank, filter, and/or another convenient separator can be used in place of or in addition to centrifuge 120. An example of a suitable centrifuge can be a decanter centrifuge. Centrifuge 120 can generate a clarified feed fraction 122 and a solids rejection fraction 125. In the configuration shown in FIG. 1, the clarified feed fraction 122 (or at least a portion thereof) can be used as the input feed to a solvent-assisted hydroprocessing reactor (or reactors) 140. In other words, in the configuration shown in FIG. 1, the clarified feed fraction corresponds to a particle size-reduced, separated fraction. The solids rejection fraction can be combined with additional solvent 127 and passed into a particle size reduction stage 130. The resulting reduced particle size solids rejection fraction 135 can, for example, be split into a particle purge stream 132 and a recycle stream 155. The recycle stream 155 can be combined with feed 105 prior to being passed into centrifuge 120.

Figure 2:
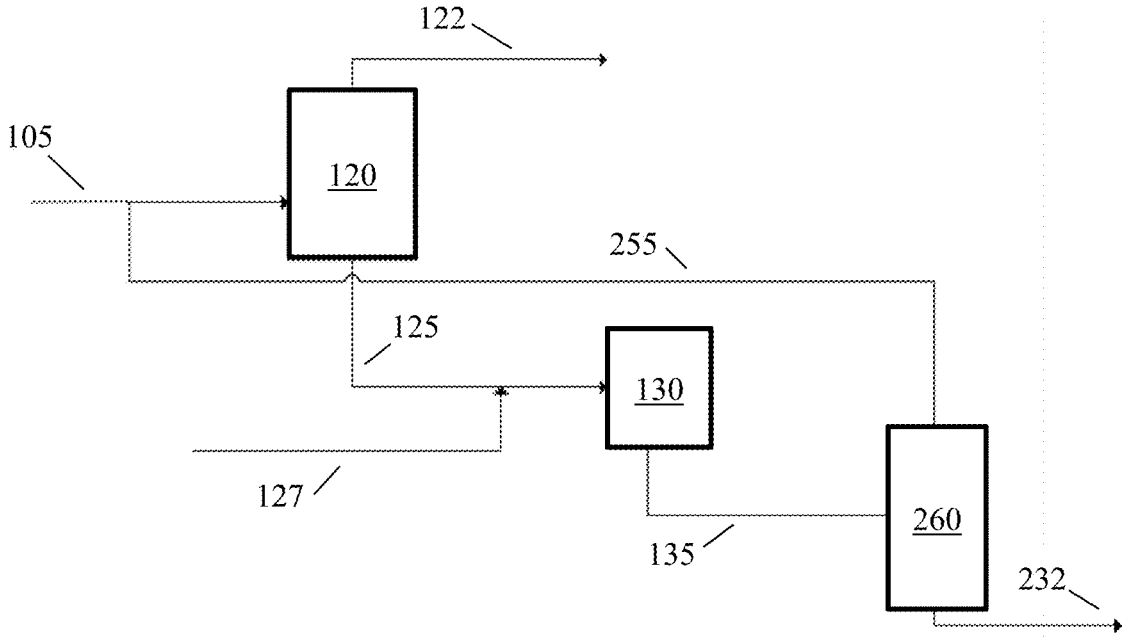
FIG. 2 schematically shows another example of a configuration for reducing the size of particles in a feed containing an SCT.

In some aspects, it may be desirable to perform additional particle separation on the reduced particle size solids rejection fraction 135, in order to improve removal of large particles. FIG. 2 shows an example of a configuration that includes an additional hydrocyclone separation stage 260. In the configuration shown in FIG. 2, hydrocyclone separation stage 260 can be used to separate the reduced particle size solids rejection fraction into a purge stream 232 and a recycle fraction 255. Using a hydrocyclone separator can increase the percentage of large particles that are included in the purge stream 232, which can provide a corresponding improvement in the efficiency of separation in centrifuge 120.

Figure 3:
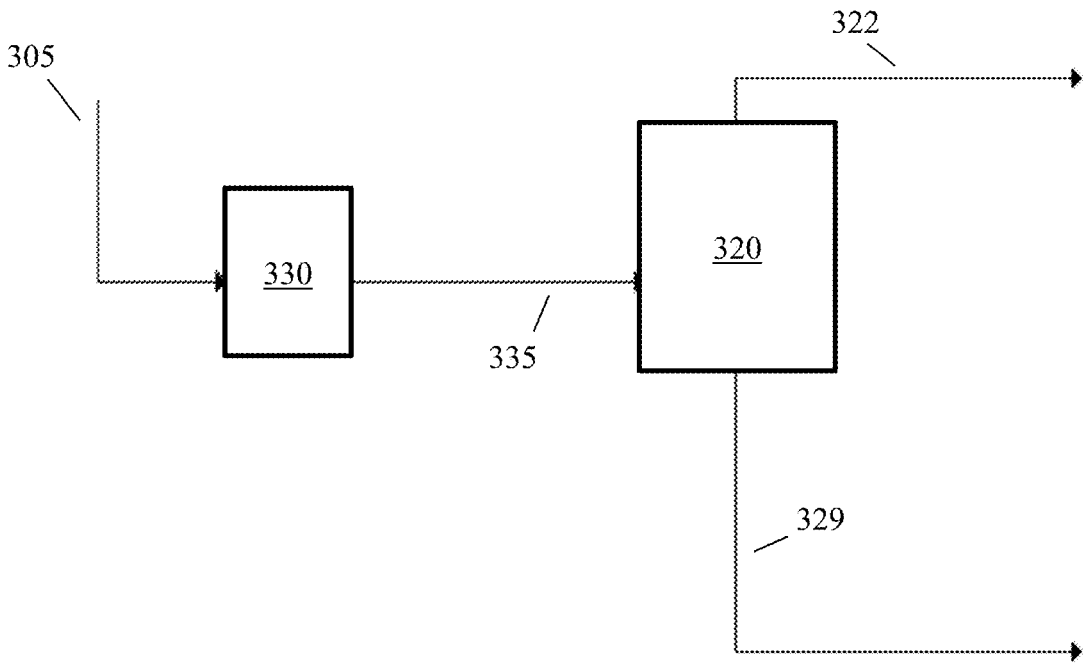
FIG. 3 schematically shows another example of a configuration for reducing the size of particles in a feed containing an SCT.

In some aspects, the particle size reduction can be performed prior to separation from the feed of the clarified feed fraction and the solids rejection fraction. FIG. 3 shows an example of this type of configuration. In FIG. 3, a feed 305 including a SCT fraction and a solvent/utility fluid can be passed into a particle size reduction process 330. The reduced particle size effluent 335 is then passed into centrifuge 320 (and/or other separator) to form clarified feed fraction 322 and a particle purge stream 329.

Steam Cracked Tar Fractions: Formation and Properties

"Tar" or steam cracker tar (SCT) as used herein is sometimes referred to in the art as "pyrolysis fuel oil". The terms can be used interchangeably herein. The tar will typically be obtained from the first (primary) fractionator downstream from a steam cracker (pyrolysis furnace) as the bottoms product of the fractionator, nominally having a boiling point of at least about 550° F.+(~288° C.+). Alternatively or in addition, SCT can be obtained as bottoms from one or more tar knock-out drums. Boiling points and/or fractional weight distillation points can be determined by, for example, ASTM D2892. Alternatively, SCT can have a T5 boiling point (temperature at which 5 wt. % will boil off) of at least about 550° F. (~288° C.). The final boiling point of SCT can be dependent on the nature of the initial pyrolysis feed and/or the pyrolysis conditions, and typically can be about 1450° F. (~788° C.) or less. It is noted that SCT is a specific type of pyrolysis tar that corresponds to a pyrolysis tar formed under conditions involving steam as a diluent.

SCT can have a relatively low hydrogen content compared to heavy oil fractions that are typically processed in a refinery setting. In some aspects, SCT can have a hydrogen content of about 8.0 wt. % or less, about 7.5 wt. % or less, or about 7.0 wt. % or less, or about 6.5 wt. % or less. In particular, SCT can have a hydrogen content of about 5.5 wt. % to about 8.0 wt. %, or about 6.0 wt. % to about 7.5 wt. %. Additionally or alternately, SCT can have a micro carbon residue (or alternatively Conradson Carbon Residue) of at least about 10 wt. %, or at least about 15 wt. %, or at least about 20 wt. %, such as up to about 40 wt. % or more.

SCT can also be highly aromatic in nature. The paraffin content of SCT can be about 2.0 wt. % or less, or about 1.0 wt. % or less, such as having substantially no paraffin content. The naphthene content of SCT can also be about 2.0 wt. % or less or about 1.0 wt. % or less, such as having substantially no naphthene content. In some aspects, the combined paraffin and naphthane content of SCT can be about 1.0 wt. % or less. With regard to aromatics, at least about 30 wt. % of SCT can correspond to 3-ring aromatics, or at least 40 wt. %. In particular, the 3-ring aromatics content can be about 30 wt. % to about 60 wt. %, or about 40 wt. % to about 55 wt. %, or about 40 wt. % to about 50 wt. %. Additionally or alternately, at least about 30 wt. % of SCT can correspond to 4-ring aromatics, or at least 40 wt. %. In particular, the 4-ring aromatics content can be about 30 wt. % to about 60 wt. %, or about 40 wt. % to about 55 wt. %, or about 40 wt. % to about 50 wt. %. Additionally or alternately, the 1-ring aromatic content can be about 15 wt. % or less, or about 10 wt. % or less, or about 5 wt. % or less, such as down to about 0.1 wt. %.

Due to the low hydrogen content and/or highly aromatic nature of SCT, the solubility number (SBN) and insolubility number (IN) of SCT can be relatively high. SCT can have a SBN of at least about 100, and in particular about 120 to about 230, or about 150 to about 230, or about 180 to about 220. Additionally or alternately, SCT can have an IN of about 70 to about 180, or about 100 to about 160, or about 80 to about 140. Further additionally or alternately, the difference between SBN and IN for the SCT can be at least about 30, or at least about 40, or at least about 50, such as up to about 150.

SCT can also have a higher density than many types of crude or refinery fractions. In various aspects, SCT can have a density at 15° C. of about 1.08 g/cm$^3$ to about 1.20 g/cm$^3$, or 1.10 g/cm$^3$ to 1.18 g/cm$^3$. By contrast, many types of vacuum resid fractions can have a density of about 1.05 g/cm$^3$ or less. Additionally or alternately, density (or weight per volume) of the heavy hydrocarbon can be determined according to ASTM D287-92 (2006) Standard Test Method for API Gravity of Crude Petroleum and Petroleum Products (Hydrometer Method), which characterizes density in terms of API gravity. In general, the higher the API gravity, the less dense the oil. API gravity can be 5° or less, or 0° or less, such as down to about −10° or lower.

Contaminants such as nitrogen and sulfur are typically found in SCT, often in organically-bound form. Nitrogen content can range from about 50 wppm to about 10,000 wppm elemental nitrogen or more, based on total weight of the SCT. Sulfur content can range from about 0.1 wt. % to about 10 wt. %, based on total weight of the SCT.

Pyrolysis tar (such as SCT) can be produced by exposing a hydrocarbon-containing feed to pyrolysis conditions in order to produce a pyrolysis effluent, the pyrolysis effluent being a mixture comprising unreacted feed, unsaturated hydrocarbon produced from the feed during the pyrolysis, and pyrolysis tar. For example, when a feed comprising 10.0 wt. % or more hydrocarbon, based on the weight of the feed, is subjected to pyrolysis, the pyrolysis effluent generally contains pyrolysis tar and 1.0 wt. % or more of $C_2$ unsaturates, based on the weight of the pyrolysis effluent. The pyrolysis tar generally comprises 90 wt. % or more of the pyrolysis effluent's molecules having an atmospheric boiling point of 290° C. or more. Besides hydrocarbon, the feed to pyrolysis optionally further comprise diluent, e.g., one or more of nitrogen, water, etc. For example, the feed may further comprise 1.0 wt. % or more diluent based on the weight of the feed, such as 25.0 wt. % or more. When the diluent includes an appreciable amount of steam, the pyrolysis is referred to as steam cracking. For the purpose of this description and appended claims, the following terms are defined:

The term "pyrolysis tar" means (a) a mixture of hydrocarbons having one or more aromatic components and optionally (b) non-aromatic and/or non-hydrocarbon molecules, the mixture being derived from hydrocarbon pyrolysis, with at least 70% of the mixture having a boiling point at atmospheric pressure that is about 550° F. (290° C.) or more. Certain pyrolysis tars have an initial boiling point of 200° C. or more. For certain pyrolysis tars, 90.0 wt. % or more of the pyrolysis tar has a boiling point at atmospheric pressure of 550° F. (290° C.) or more. Pyrolysis tar can comprise, e.g., 50.0 wt. % or more, or 75.0 wt. % or more, such as 90.0 wt. % or more, based on the weight of the pyrolysis tar, of hydrocarbon molecules (including mixtures and aggregates thereof) having (i) one or more aromatic components and (ii) a number of carbon atoms greater than about 15. Pyrolysis tar generally has a metals content of 1000 ppmw or less, based on the weight of the pyrolysis tar, which is an amount of metals that is far less than that found in crude oil (or crude oil components) of the same average viscosity. "SCT" means pyrolysis tar obtained from steam cracking.

"Tar Heavies" (TH) means a product of hydrocarbon pyrolysis, the TH having an atmospheric boiling point of 565° C. or more and comprising 5.0 wt. % or more of molecules having a plurality of aromatic cores based on the weight of the product. The TH are typically solid at 25° C. and generally include the fraction of SCT that is not soluble in a 5:1 (vol.:vol.) ratio of n-pentane: SCT at 250° C. TH generally include asphaltenes and other high molecular weight molecules.

In some aspects, conventional steam cracking can be used to generate a SCT fraction. Conventional steam cracking utilizes a pyrolysis furnace which has two main sections: a convection section and a radiant section. The pyrolysis feedstock typically enters the convection section of the furnace where the pyrolysis feedstock's hydrocarbon is heated and vaporized by indirect contact with hot flue gas from the radiant section and by direct contact with the pyrolysis feedstock's steam. The vaporized pyrolysis feedstock is then introduced into the radiant section where 50% or more (weight basis) of the cracking takes place. A pyrolysis effluent is conducted away from the pyrolysis furnace, the pyrolysis effluent comprising products resulting from the pyrolysis of the pyrolysis feedstock and any unconverted components of the pyrolysis feedstock. At least one separation stage is generally located downstream of the pyrolysis furnace, the separation stage being utilized for separating from the pyrolysis effluent one or more of light olefin, SCN, SCGO, SCT, water, unreacted hydrocarbon components of the pyrolysis feedstock, etc. The separation stage can comprise, e.g., a primary fractionator. Generally, a cooling stage is located between the pyrolysis furnace and the separation stage. Conventional cooling means can be utilized by the cooling stage, e.g., one or more of direct quench and/or indirect heat exchange, but the invention is not limited thereto.

In certain aspects, the pyrolysis tar is an SCT (or mixture of SCTs) produced in one or more steam cracking furnaces. Besides SCT, such furnaces generally produce (i) vapor-phase products such as one or more of acetylene, ethylene, propylene, butenes, and (ii) liquid-phase products comprising, e.g., one or more of $C_{5+}$ molecules, and mixtures thereof. The liquid-phase products are generally conducted together to a separation stage, e.g., a primary fractionator, for separation of one or more of (a) overheads comprising steam-cracked naphtha ("SCN", e.g., $C_5$-$C_{10}$ species) and steam cracked gas oil ("SCGO"), the SCGO comprising 90.0 wt. % or more based on the weight of the SCGO of molecules (e.g., $C_{10}$-$C_{17}$ species) having an atmospheric boiling point in the range of about 400° F. to 550° F. (200° C. to 290° C.), and (b) a bottoms stream comprising 90.0 wt. % or more SCT, based on the weight of the bottoms stream. The SCT can have, e.g., a boiling range of roughly 550° F. (290° C.) or more and can comprise molecules and mixtures thereof having a number of carbon atoms of about 15 or more.

The pyrolysis feedstock typically comprises hydrocarbon and steam. In certain aspects, the pyrolysis feedstock comprises 10 wt. % or more hydrocarbon, based on the weight of the pyrolysis feedstock, or 25 wt. % or more, or 50 wt. % or more, such as up to 65 wt. % or possibly still higher. Although the pyrolysis feedstock's hydrocarbon can comprise one or more of light hydrocarbons such as methane, ethane, propane, butane etc., it can be particularly advantageous to utilize the invention in connection with a pyrolysis feedstock comprising a significant amount of higher molecular weight hydrocarbons because the pyrolysis of these molecules generally results in more SCT than does the pyrolysis of lower molecular weight hydrocarbons. As an example, the pyrolysis feedstock can comprise 1.0 wt. % or more (or 25.0 wt. % or more) of hydrocarbons that are in the liquid phase at ambient temperature and atmospheric pressure, based on the weight of the pyrolysis feedstock. More than one steam cracking furnace can be used, and these can be operated (i) in parallel, where a portion of the pyrolysis feedstock is transferred to each of a plurality of furnaces, (ii) in series, where at least a second furnace is located downstream of a first furnace, the second furnace being utilized for cracking unreacted pyrolysis feedstock components in the first furnace's pyrolysis effluent, and (iii) a combination of (i) and (ii).

In certain aspects, the pyrolysis feedstock comprises steam in an amount in the range of from 10.0 wt. % to 90.0 wt. %, based on the weight of the pyrolysis feedstock, with the remainder of the pyrolysis feedstock comprising (or consisting essentially of, or consisting of) the hydrocarbon. Such a pyrolysis feedstock can be produced by combining hydrocarbon with steam, e.g., at a ratio of 0.1 to 1.0 kg steam per kg hydrocarbon, or a ratio of 0.2 to 0.6 kg steam per kg hydrocarbon.

When the pyrolysis feedstock's diluent comprises steam, the pyrolysis can be carried out under conventional steam cracking conditions. Suitable steam cracking conditions include, e.g., exposing the pyrolysis feedstock to a temperature (measured at the radiant outlet) of 400° C. or more, e.g., in the range of 400° C. to 900° C., and a pressure of 0.1 bar-g (~10 kPa-g), for a cracking residence time period in the range of from about 0.01 second to 5.0 second. In certain aspects, the pyrolysis feedstock comprises hydrocarbon and diluent, wherein; a. the pyrolysis feedstock's hydrocarbon comprises 50.0 wt. % or more, based on the weight of the pyrolysis feedstock's hydrocarbon, of one or more of one or more crude oils and/or one or more crude oil fractions, such as those obtained from an APS and/or VPS; waxy residues: atmospheric residues; naphthas contaminated with crude; various residue admixtures; and SCT; and b. the pyrolysis feedstock's diluent comprises, e.g., 95.0 wt. % or more water based on the weight of the diluent, wherein the amount of diluent in the pyrolysis feedstock is in the range of from about 10.0 wt. % to 90.0 wt. %, based on the weight of the pyrolysis feedstock. In these aspects, the steam cracking conditions generally include one or more of (i) a temperature in the range of 760° C. to 880° C.; (ii) a pressure in the range of from 1.0 to 5.0 bar (absolute) (~100 kPa-a to 500 kPa-a), or (iii) a cracking residence time in the range of from 0.10 to 2.0 seconds.

A pyrolysis effluent is conducted away from the pyrolysis furnace, the pyrolysis effluent being derived from the pyrolysis feedstock by the pyrolysis. When utilizing the specified pyrolysis feedstock and pyrolysis conditions of any of the preceding aspects, the pyrolysis effluent generally comprises 1.0 wt. % or more of $C_2$ unsaturates and 0.1 wt. % or more of TH, the weight percents being based on the weight of the pyrolysis effluent. Optionally, the pyrolysis effluent comprises 5.0 wt. % or more of $C_2$ unsaturates and/or 0.5 wt. % or more of TH, such as 1.0 wt. % or more TH. Although the pyrolysis effluent generally contains a mixture of the desired light olefins, SCN, SCGO, SCT, and unreacted components of the pyrolysis feedstock (e.g., water in the case of steam cracking, but also in some cases unreacted hydrocarbon), the relative amount of each of these generally depends on, e.g., the pyrolysis feedstock's composition, pyrolysis furnace configuration, process conditions during the pyrolysis, etc. The pyrolysis effluent is generally conducted away for the pyrolysis section, e.g., for cooling and separation.

In certain aspects, the pyrolysis effluent's TH comprise 10.0 wt. % or more of TH aggregates having an average size in the range of 10.0 nm to 300.0 nm in at least one dimension and an average number of carbon atoms the weight percent being based on the weight of Tar Heavies in the pyrolysis effluent. Generally, the aggregates comprise 50.0 wt. % or more, e.g., 80.0 wt. % or more, such as 90.0 wt. % or more, of TH molecules having a C: H atomic ratio in the range of from 1.0 to 1.8, a molecular weight in the range of 250 to 5000, and a melting point in the range of 100° C. to 700° C.

A separation stage can be utilized downstream of the pyrolysis furnace and downstream of the transfer line exchanger and/or quench point for separating from the pyrolysis effluent one or more of light olefin, SCN, SCGO, SCT, or water. Conventional separation equipment can be utilized in the separation stage, e.g., one or more flash drums, fractionators, water-quench towers, indirect condensers, etc., such as those described in U.S. Pat. No. 8,083,931. The separation stage can be utilized for separating an SCT-containing tar stream (the "tar stream") from the pyrolysis effluent. The tar stream typically contains 90.0 wt. % or more of SCT based on the weight of the tar stream, e.g., 95.0 wt. % or more, such as 99.0 wt. % or more, with the balance of the tar stream being particulates, for example. The tar stream's SCT generally comprises 10.0% or more (on a weight basis) of the pyrolysis effluent's TH. The tar stream can be obtained, e.g., from an SCGO stream and/or a bottoms stream of the steam cracker's primary fractionator, from flash-drum bottoms (e.g., the bottoms of one or more flash drums located downstream of the pyrolysis furnace and upstream of the primary fractionator), or a combination thereof. For example, the tar stream can be a mixture of primary fractionator bottoms and tar knock-out drum bottoms.

In certain aspects, the SCT comprises 50.0 wt. % or more of the pyrolysis effluent's TH based on the weight of the pyrolysis effluent's TH. For example, the SCT can comprise 90.0 wt. % or more of the pyrolysis effluent's TH based on the weight of the pyrolysis effluent's TH. The SCT can have, e.g., (i) a sulfur content in the range of 0.5 wt. % to 7.0 wt. %, based on the weight of the SCT; (ii) a TH content in the range of from 5.0 wt. % to 40.0 wt. %, based on the weight of the SCT; (iii) a density at 15° C. in the range of 1.01 g/cm$^3$ to 1.15 g/cm$^3$, e.g., in the range of 1.07 g/cm$^3$ to 1.15 g/cm$^3$; and (iv) a kinematic viscosity at 50° C. in the range of 200 cSt to $1.0\times10^7$ cSt. The amount of olefin the SCT is generally 10.0 wt. % or less, e.g., 5.0 wt. % or less, such as 2.0 wt. % or less, based on the weight of the SCT. More particularly, the amount of (i) vinyl aromatics in the SCT and/or (ii) aggregates in the SCT which incorporate vinyl aromatics is generally 5.0 wt. % or less, e.g., 3 wt. % or less, such as 2.0 wt. % or less, based on the weight of the SCT.

Optionally, the pyrolysis furnace has at least one vapor/liquid separation device (sometimes referred to as flash pot or flash drum) integrated therewith, typically integrated with the furnace's convection section. The vapor-liquid separator is utilized for upgrading the pyrolysis feedstock before exposing it to pyrolysis conditions in the furnace's radiant section. It can be desirable to integrate a vapor-liquid separator with the pyrolysis furnace when the pyrolysis feedstock's hydrocarbon comprises 1.0 wt. % or more of non-volatiles, e.g., 5.0 wt. % or more, such as 5.0 wt. % to 50.0 wt. % of non-volatiles having a nominal boiling point 1400° F. (760° C.) or more. The boiling point distribution and nominal boiling points of the pyrolysis feedstock's hydrocarbon are measured by Gas Chromatograph Distillation (GCD) according to the methods described in ASTM D-6352-98 or D-2887, extended by extrapolation for materials having a boiling point at atmospheric pressure ("atmospheric boiling point) 700° C. (1292° F.) or more. It is particularly desirable to integrate a vapor/liquid separator with the pyrolysis furnace when the non-volatiles comprise asphaltenes, such as pyrolysis feedstock's hydrocarbon comprises about 0.1 wt. % or more asphaltenes based on the weight of the pyrolysis feedstock's hydrocarbon component, e.g., about 5.0 wt. % or more. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety. Generally, when using a vapor/liquid separation device, the composition of the vapor phase leaving the device is substantially the same as the composition of the vapor phase entering the device, and likewise the composition of the liquid phase leaving the device is substantially the same as the composition of the liquid phase entering the device, i.e., the separation in the vapor/liquid separation device includes (or even consists essentially of) a physical separation of the two phases entering the device.

In aspects which include integrating a vapor/liquid separation device with the pyrolysis furnace, at least a portion of the pyrolysis feedstock's hydrocarbon is provided to the inlet of a convection section of a pyrolysis unit, wherein hydrocarbon is heated so that at least a portion of the hydrocarbon is in the vapor phase. When a diluent (e.g., steam) is utilized, the pyrolysis feedstock's diluent is optionally (but preferably) added in this section and mixed with the hydrocarbon to produce the pyrolysis feedstock. The pyrolysis feedstock, at least a portion of which is in the vapor phase, is then flashed in at least one vapor/liquid separation device in order to separate and conduct away from the pyrolysis feedstock at least a portion of the pyrolysis feedstock's non-volatiles, e.g., high molecular-weight non-volatile molecules, such as asphaltenes. A bottoms fraction can be conducted away from the vapor-liquid separation device, the bottoms fraction comprising, e.g., 10.0% or more (on a wt. basis) of the pyrolysis feedstock's non-volatiles, such as 10.0% or more (on a wt. basis) of the pyrolysis feedstock's asphaltenes.

Generally, SCT has high solubility blending number values, for example, $S_{BN}>135$, and high incompatibility number, for example, $I_N\geq80$, making them difficult to blend with other heavy hydrocarbons. In aspects where a vapor-liquid separator is integrated with the pyrolysis furnace, it has been observed that SCT has even higher $S_{BN}$ and $I_N$ making these SCT particularly difficult to blend and hydroprocess. For example, SCT can have an $S_{BN}$ of 170 or more, or 200 or more, such as up to 250 or possibly still higher. SCT can have an $I_N$ of 110 or more, or 120 or more, or 130 or more, such as up to 170 or possibly still higher.

Solvent-Assisted Hydroprocessing of Pyrolysis Tar

After performing particle size reduction on a pyrolysis tar fraction (such as an SCT fraction), the pyrolysis tar fraction can be hydroprocessed under solvent-assisted hydroprocessing conditions. This can involve adding an aromatic solvent, such as a utility fluid, to the pyrolysis tar fraction to facilitate hydroprocessing.

In certain aspects, a utility fluid can include aromatics, e.g., 70.0 wt. % or more aromatics, based on the weight of the utility fluid, such as 80.0 wt. % or more, or 90.0 wt. % or more. Typically, the utility fluid comprises 10.0 wt. % or less of paraffin, based on the weight of the utility fluid. For example, the utility fluid can comprise 95.0 wt. % or more of aromatics, 5.0 wt. % or less of paraffin. Optionally, the utility fluid has a final boiling point of 750° C. (1400° F.) or less, e.g., 570° C. (1050° F.) or less, such as 430° C. (806° F.) or less. Such utility fluids can comprise 25.0 wt. % or more of 1-ring and 2-ring aromatics (i.e., those aromatics having one or two rings and at least one aromatic core), based on the weight of the utility fluid. Utility fluids having a relatively low final boiling point can be used, e.g., a utility fluid having a final boiling point of 400° C. (750° F.) or less. The utility fluid can have an 10% (weight basis) total boiling point of 120° C. or more, e.g., 140° C. or more, such as 150° C. or more and/or a 90% total boiling point of 430° C. or less, e.g., 400° C. or less. Suitable utility fluids include those having a true boiling point distribution generally in the range of from 175° C. (350° F.) to about 400° C. (750° F.). A true boiling point distribution can be determined, e.g., by conventional methods such as the method of ASTM D7500. It is generally desirable for the utility fluid to be substantially free of molecules having alkenyl functionality, particularly in aspects utilizing a hydroprocessing catalyst having a tendency for coke formation in the presence of such molecules.

Certain solvents and solvent mixtures can be used as utility fluid, including SCN, SCGO, and/or other solvent comprising aromatics, such as those solvents comprising 90.0 wt. % or more, e.g., 95.0 wt. % or more, such as 99.0 wt. % or more of aromatics, based on the weight of the solvent. Representative aromatic solvents that are suitable for use as utility fluid include A200 solvent, available from ExxonMobil Chemical Company (Houston Tex.), CAS number 64742-94-5.

After SCT hydroprocessing is operating in the steady-state, under specified SCT hydroprocessing conditions, at least a portion of the utility fluid can be obtained from the hydroprocessed product, e.g., by separating and re-cycling a portion of the hydroprocessed product. Methods for obtaining a suitable utility fluid from the hydroprocessed product are disclosed, e.g., in U.S. Patent Application Publication No. 2014-0061096 and in Provisional U.S. Patent Application No. 61/986,316. When utilizing a utility fluid that is obtained at least in part from the hydroprocessed product, a portion thereof can be stored for later use. The stored utility fluid can be used, e.g., a primer fluid when re-starting SCT hydroprocessing after a shut-down and/or when starting a second SCT hydroprocessor. Should the amount of utility fluid derived from the process be insufficient for producing an SCT-utility fluid mixture of the specified relative amounts of SCT and utility fluid, additional utility fluid can be obtained from supplemental source ("supplemental utility fluid"). The supplemental utility fluid can comprise one or more of the specified solvents or solvent mixtures, and stored utility fluid.

The relative amounts of utility fluid and SCT during hydroprocessing are generally in the range of from about 20.0 wt. % to about 95.0 wt. % of the SCT and from about 5.0 wt. % to about 80.0 wt. % of the utility fluid, based on total weight of utility fluid plus SCT. For example, the relative amounts of utility fluid and SCT can be in the range of (i) about 20.0 wt. % to about 90.0 wt. % of the SCT, e.g., about 40.0 wt. % to about 90.0 wt. %, and about 10.0 wt. % to about 80.0 wt. % of the utility fluid, e.g., about 10.0 wt. % to about 60.0 wt. % of the utility. In certain aspects, the combined SCT+utility fluid has a utility fluid: SCT weight ratio of 0.01 or more, e.g., in the range of 0.05 to 4.0, such as in the range of 0.1 to 3.0, or 0.3 to 1.1. At least a portion of the utility fluid can be combined with at least a portion of the SCT within the hydroprocessing vessel or hydroprocessing zone, but this is not required, and in certain aspects at least a portion of the utility fluid and at least a portion of the SCT are supplied as separate streams and combined into one stream prior to entering, e.g., upstream of the hydroprocessing stage(s). The relative amount of primer fluid and SCT during start-up can be substantially the same as the relative amounts of utility fluid and SCT during SCT hydroprocessing.

The temperature and pressure of the hydroprocessing conditions should be selected with consideration of the boiling point of the solvent. Preferably, the solvent should be in liquid phase but at high enough temperature to increase the tar molecule solvency. Higher temperatures and lower pressures are not preferred as significant solvent hydrogenation can occur.

SCT hydroprocessing in the presence of the utility fluid can be carried out in one or more hydroprocessing stages, the stages comprising one or more hydroprocessing vessels or zones. Vessels and/or zones within the hydroprocessing stage in which catalytic hydroprocessing activity occurs generally include at least one of the specified hydroprocessing catalyst. The catalysts can be mixed or stacked, such as when the catalyst is in the form of one or more fixed beds in a vessel or hydroprocessing zone.

The hydroprocessing is carried out in the presence of molecular hydrogen, e.g., by (i) combining molecular hydrogen with the SCT and/or utility fluid upstream of the hydroprocessing and/or (ii) conducting molecular hydrogen to the hydroprocessing stage in one or more conduits or lines. Although relatively pure molecular hydrogen can be utilized for the hydroprocessing, it is generally desirable to utilize a "treat gas" which contains sufficient molecular hydrogen for the hydroprocessing and optionally other species (e.g., nitrogen and light hydrocarbons such as methane) which generally do not adversely interfere with or affect either the reactions or the products. Unused treat gas can be separated from the hydroprocessed product for re-use, generally after removing undesirable impurities, such as $H_2S$ and $NH_3$. The treat gas optionally contains about 50 vol. % or more of molecular hydrogen, e.g., about 75 vol. % or more, based on the total volume of treat gas conducted to the hydroprocessing stage.

Optionally, the amount of molecular hydrogen supplied to the hydroprocessing stage is 75 S $m^3/m^3$ or more (standard $m^3$ of molecular hydrogen per $m^3$ of (SCT plus utility fluid)). Optionally, the amount of molecular hydrogen is in the range of from about 300 SCF/B (standard cubic feet per barrel of (SCT+utility fluid)) (53 S $m^3/m^3$) to 5000 SCF/B (890 S $m^3/m^3$), such as 1000 SCF/B (178 S $m^3/m^3$) to 3000 SCF/B (534 S $m^3/m^3$). Hydroprocessing the SCT in the presence of the specified utility fluid, molecular hydrogen, and a catalytically effective amount of the specified hydroprocessing catalyst under catalytic hydroprocessing conditions produces a hydroprocessed product including, e.g., upgraded SCT. An example of suitable catalytic hydroprocessing conditions will now be described in more detail. The invention is not limited to these conditions, and this description is not meant to foreclose other hydroprocessing conditions within the broader scope of the invention.

SCT hydroprocessing is generally carried out under hydroconversion conditions, e.g., under conditions for carrying out one or more of hydrocracking (including selective hydrocracking), hydrogenation, hydrotreating, hydrodesulurization, hydrodenitrogenation, hydrodemetallation, hydrodearomatization, hydroisomerization, or hydrodewaxing. The hydroprocessing reaction can be carried out in at least one vessel or zone that is located, e.g., within a hydroprocessing stage downstream of the pyrolysis stage and separation stage. The specified SCT contacts the hydroprocessing catalyst in the vessel or zone, in the presence of the utility fluid and molecular hydrogen. Catalytic hydroprocessing conditions can include, e.g., exposing the combined (SCT+utility fluid) mixture to a temperature in the range from 50° C. to 500° C., or from 200° C. to 450° C., or from 220° C. to 430° C., or from 350° C. to 420° C. proximate to the molecular hydrogen and hydroprocessing catalyst. For example, a temperature in the range of from 300° C. to 500° C., or 350° C. to 430° C. can be utilized. Liquid hourly space velocity (LHSV) of the combined SCT+utility fluid volume per volume of catalyst can be 0.1 $h^{-1}$ or more, e.g., in the range of from 0.1 $h^{-1}$ to 30 $h^{-1}$, or 0.4 $h^{-1}$ to 25 $h^{-1}$, or 0.5 $h^{-1}$ to 20 $h^{-1}$. In certain aspects, LHSV is at least 5 $h^{-1}$, or at least 10 $h^{-1}$, or at least 15 $h^{-1}$. In other aspects, LHSV is in the range of from 0.1 to 2.0, e.g., 0.25 to 0.50. Molecular hydrogen partial pressure during the hydroprocessing is generally in the range of from 0.1 MPa to 8 MPa, or 1 MPa to 7 MPa, or 2 MPa to 6 MPa, or 3 MPa to 5 MPa. In certain aspects, the partial pressure of molecular hydrogen is 7 MPa or less, or 5 MPa or less, or 3 MPa or less, or 2 MPa or less. Total pressure during the hydroprocessing is generally 10 bar gauge or more, e.g., in the range of 15 bar gauge [bar(g)] to 135 bar(g), or 20 bar(g) to 120 bar(g), or 20 bar(g) to 100 bar(g). Molecular hydrogen consumption rate is based on the volume of molecular hydrogen per volume of SCT. Generally, molecular hydrogen consumption rate is in the range of about 53 standard cubic meters/cubic meter (S $m^3/m^3$) (300 SCF/B) to 1767 S $m^3/m^3$ (10,000 SCF/B), e.g., 148 S $m^3/m^3$ (835 SCF/B) to 1180 S $m^3/m^3$ (6680 SCF/B), such as 177 S $m^3/m^3$ (1000 SCF/B) to 442 S $m^3/m^3$ (2500 SCF/B). In particular aspects, the hydroprocessing conditions include one or more of a temperature in the range of 360° C. to 430° C., e.g., 375° C. to 425° C., such as 385° C. to 415° C.; a pressure in the range of 47 bar(g) (700 psig) to 133 bar(g) (2000 psig), e.g., 60 bar(g) (900 psig) to 87 bar(g) (1300 psig), a molecular hydrogen consumption rate in the range of 148 S $m^3/m^3$ (835 SCF/B) to 1180 S $m^3/m^3$ (6680 SCF/B), e.g., 177 S $m^3/m^3$ (1000 SCF/B) to 442 S $m^3/m^3$ (2500 SCF/B); and an LHSV in the range of from 0.1 to 2.0, e.g., 0.25 to 0.50. When operated under these conditions using the specified catalyst, TH conversion is generally 25% or more on a weight basis, e.g., 50% or more, resulting in the SCT having desirable viscosity and blending characteristics.

Effluent is conducted away from the hydroprocessor, the effluent comprising converted SCT, unconverted SCT, unconverted treat gas, utility fluid, hydrogen sulfide, etc., a vapor-phase portion is separated from the effluent and conducted away, the vapor-phase portion having a final boiling point <40° C. and comprising molecular hydrogen, hydrogen sulfide, and light hydrocarbon gasses. The remainder of the effluent can be subjected to further separations, e.g., one or more of (i) separating an aromatics-containing stream having a boiling range of about 40° C. to about 430° C., e.g., about 170° C. to about 430° C., or about 200° C. to about 430° C., or about 175° C. to about 400° C., or about 200° C. to about 400° C., and (ii) a hydroprocessed SCT having a true boiling range of 400° C. or more, e.g., 430° C. or more. At least a portion of the separated aromatics-containing stream can be recycled to the process for use as utility fluid.

Conventional hydroprocessing catalyst can be utilized for hydroprocessing the tar stream in the presence of the utility fluid, such as conventional catalysts used for resid and/or heavy oil hydroprocessing, but the invention is not limited thereto. Suitable hydroprocessing catalysts include those comprising (i) one or more bulk metals and/or (ii) one or more metals on a support. The metals can be in elemental form or in the form of a compound. In certain aspects, the hydroprocessing catalyst includes at least one metal from any of Groups 5 to 10 of the Periodic Table of the Elements (tabulated as the Periodic Chart of the Elements, The Merck Index, Merck & Co., Inc., 1996). Examples of such catalytic metals include, but are not limited to, vanadium, chromium, molybdenum, tungsten, manganese, technetium, rhenium, iron, cobalt, nickel, ruthenium, palladium, rhodium, osmium, iridium, platinum, or mixtures thereof.

In certain aspects, the catalyst has a total amount of Groups 5 to 10 metals per gram of catalyst of at least 0.0001 grams, or at least 0.001 grams or at least 0.01 grams, in which grams are calculated on an elemental basis. For example, the catalyst can comprise a total amount of Group 5 to 10 metals in a range of from 0.0001 grams to 0.6 grams, or from 0.001 grams to 0.3 grams, or from 0.005 grams to 0.1 grams, or from 0.01 grams to 0.08 grams. In a particular embodiment, the catalyst further comprises at least one Group 15 element. An example of a preferred Group 15 element is phosphorus. When a Group 15 element is utilized, the catalyst can include a total amount of elements of Group 15 in a range of from 0.000001 grams to 0.1 grams, or from 0.00001 grams to 0.06 grams, or from 0.00005 grams to 0.03 grams, or from 0.0001 grams to 0.001 grams, in which grams are calculated on an elemental basis.

In an embodiment, the catalyst comprises at least one Group 6 metal. Examples of preferred Group 6 metals include chromium, molybdenum and tungsten. The catalyst may contain, per gram of catalyst, a total amount of Group 6 metals of at least 0.00001 grams, or at least 0.01 grams, or at least 0.02 grams, in which grams are calculated on an elemental basis. For example the catalyst can contain a total amount of Group 6 metals per gram of catalyst in the range of from 0.0001 grams to 0.6 grams, or from 0.001 grams to 0.3 grams, or from 0.005 grams to 0.1 grams, or from 0.01 grams to 0.08 grams, the number of grams being calculated on an elemental basis.

In related embodiments, the catalyst includes at least one Group 6 metal and further includes at least one metal from Group 5, Group 7, Group 8, Group 9, or Group 10. Such catalysts can contain, e.g., the combination of metals at a molar ratio of Group 6 metal to Group 5 metal in a range of from 0.1 to 20, 1 to 10, or 2 to 5, in which the ratio is on an elemental basis. Alternatively, the catalyst will contain the combination of metals at a molar ratio of Group 6 metal to a total amount of Groups 7 to 10 metals in a range of from 0.1 to 20, 1 to 10, or 2 to 5, in which the ratio is on an elemental basis.

When the catalyst includes at least one Group 6 metal and one or more metals from Groups 9 or 10, e.g., molybdenum-cobalt and/or tungsten-nickel, these metals can be present, e.g., at a molar ratio of Group 6 metal to Groups 9 and 10 metals in a range of from 1 to 10, or from 2 to 5, in which the ratio is on an elemental basis. When the catalyst includes at least one of Group 5 metal and at least one Group 10 metal, these metals can be present, e.g., at a molar ratio of Group 5 metal to Group 10 metal in a range of from 1 to 10, or from 2 to 5, where the ratio is on an elemental basis. Catalysts which further comprise inorganic oxides, e.g., as a binder and/or support, are within the scope of the invention. For example, the catalyst can comprise (i) 1.0 wt. % or more of one or more metals selected from Groups 6, 8, 9, and 10 of the Periodic Table and (ii) 1.0 wt. % or more of an inorganic oxide, the weight percents being based on the weight of the catalyst.

In certain aspects, the catalyst is a bulk multimetallic hydroprocessing catalyst with or without binder. In an embodiment the catalyst is a bulk trimetallic catalyst comprised of two Group 8 metals, preferably Ni and Co and the one Group 6 metals, preferably Mo.

The invention encompasses incorporating into (or depositing on) a support one or catalytic metals e.g., one or more metals of Groups 5 to 10 and/or Group 15, to form the hydroprocessing catalyst. The support can be a porous material. For example, the support can comprise one or more refractory oxides, porous carbon-based materials, zeolites, or combinations thereof suitable refractory oxides include, e.g., alumina, silica, silica-alumina, titanium oxide, zirconium oxide, magnesium oxide, and mixtures thereof. Suitable porous carbon-based materials include, activated carbon and/or porous graphite. Examples of zeolites include, e.g., Y-zeolites, beta zeolites, mordenite zeolites, ZSM-5 zeolites, and ferrierite zeolites. Additional examples of support materials include gamma alumina, theta alumina, delta alumina, alpha alumina, or combinations thereof. The amount of gamma alumina, delta alumina, alpha alumina, or combinations thereof, per gram of catalyst support, can be in a range of from 0.0001 grams to 0.99 grams, or from 0.001 grams to 0.5 grams, or from 0.01 grams to 0.1 grams, or at most 0.1 grams, as determined by x-ray diffraction. In a particular embodiment, the hydroprocessing catalyst is a supported catalyst, the support comprising at least one alumina, e.g., theta alumina, in an amount in the range of from 0.1 grams to 0.99 grams, or from 0.5 grams to 0.9 grams, or from 0.6 grams to 0.8 grams, the amounts being per gram of the support. The amount of alumina can be determined using, e.g., x-ray diffraction. In alternative embodiments, the support can comprise at least 0.1 grams, or at least 0.3 grams, or at least 0.5 grams, or at least 0.8 grams of theta alumina.

When a support is utilized, the support can be impregnated with the desired metals to form the hydroprocessing catalyst. The support can be heat-treated at temperatures in a range of from 400° C. to 1200° C., or from 450° C. to 1000° C., or from 600° C. to 900° C., prior to impregnation with the metals. In certain aspects, the hydroprocessing catalyst can be formed by adding or incorporating the Groups 5 to 10 metals to shaped heat-treated mixtures of support. This type of formation is generally referred to as overlaying the metals on top of the support material. Optionally, the catalyst is heat treated after combining the support with one or more of the catalytic metals, e.g., at a temperature in the range of from 150° C. to 750° C., or from 200° C. to 740° C., or from 400° C. to 730° C. Optionally, the catalyst is heat treated in the presence of hot air and/or oxygen-rich air at a temperature in a range between 400° C. and 1000° C. to remove volatile matter such that at least a portion of the Groups 5 to 10 metals are converted to their corresponding metal oxide. In other embodiments, the catalyst can be heat treated in the presence of oxygen (e.g., air) at temperatures in a range of from 35° C. to 500° C., or from 100° C. to 400° C., or from 150° C. to 300° C. Heat treatment can take place for a period of time in a range of from 1 to 3 hours to remove a majority of volatile components without converting the Groups 5 to 10 metals to their metal oxide form. Catalysts prepared by such a method are generally referred to as "uncalcined" catalysts or "dried." Such catalysts can be prepared in combination with a sulfiding method, with the Groups 5 to 10 metals being substantially dispersed in the support. When the catalyst comprises a theta alumina support and one or more Groups 5 to 10 metals, the catalyst is generally heat treated at a temperature of 400° C. or more to form the hydroprocessing catalyst. Typically, such heat treating is conducted at temperatures of 1200° C. or less.

In certain aspects, a relatively large surface area can be desirable. As an example, the hydroprocessing catalyst can have a surface area of 60 $m^2/g$ or more, or 100 $m^2/g$ or more, or 120 $m^2/g$ or more, or 170 $m^2/g$ or more, or 220 $m^2/g$ or more, or 270 $m^2/g$ or more; such as in the range of from 100 $m^2/g$ to 300 $m^2/g$, or 120 $m^2/g$ to 270 $m^2/g$, or 130 $m^2/g$ to 250 $m^2/g$, or 170 $m^2/g$ to 220 $m^2/g$.

Conventional hydrotreating catalysts can be used, but the invention is not limited thereto. In certain aspects, the catalysts include one or more of KF860 available from Albemarle Catalysts Company LP, Houston Tex.; Nebula® Catalyst, such as Nebula® 20, available from the same source; Centera® catalyst, available from Criterion Catalysts and Technologies, Houston Tex., such as one or more of DC-2618, DN-2630, DC-2635, and DN-3636; Ascent® Catalyst, available from the same source, such as one or more of DC-2532, DC-2534, and DN-3531; and FCC pretreat catalyst, such as DN3651 and/or DN3551, available from the same source. However, the invention is not limited to only these catalysts.

When numerical lower limits and numerical upper limits are listed herein, ranges from any lower limit to any upper limit are contemplated. Although illustrative forms are described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous forms and specific examples. Many variations will suggest themselves to those skilled in this art in light of the above detailed description. All such obvious variations are within the full intended scope of the appended claims.

What is claimed is:

1. A method for processing a feedstock including at least a portion of a pyrolysis tar, comprising:

separating a solids rejection fraction and a clarified feed fraction from a feedstock comprising a pyrolysis tar portion and a utility fluid, the feedstock comprising particles having a particle size of 50 μm or more, the solids rejection fraction comprising 60 wt. % or more of the particles having a particle size of 50 μm or more from the feedstock;

exposing at least a portion of the solids rejection fraction to a physical particle size reduction process to form a reduced particle-size solids-containing fraction, wherein the physical particle size reduction process includes converting a portion of the particles having a particle size of 50 μm or more to particles having a particle size of less than 50 μm;

combining at least a recycle portion of the reduced particle-size solids-containing fraction with a) the feedstock prior to separating the solids rejection fraction and the clarified feed fraction from the feedstock, b) the solids rejection fraction prior to exposing the solids rejection fraction to the physical particle size reduction process, or c) a combination thereof; and hydroprocessing at least a portion of the clarified feed fraction under solvent-assisted hydroprocessing conditions to form a hydroprocessed effluent, the clarified feed fraction comprising 10 wppm to 10000 wppm of particles having a particle size of 0.1 μm to 50 μm.

2. The method of claim 1, wherein the clarified feed fraction comprises i) 10 wppm to 150 wppm of particles having a particle size of 0.1 μm to 50 μm;

ii) 50 wppm to 500 wppm of particles having a particle size of 0.1 μm to 50 μm; or iii) 100 wppm to 1000 wppm of particles having a particle size of 0.1 μm to 50 μm.

3. The method of claim 1, wherein the clarified feed fraction comprises i) 10 wppm to 150 wppm of particles having a particle size of 0.1 μm to 25 μm;

ii) 50 wppm to 500 wppm of particles having a particle size of 0.1 μm to 25 μm;

iii) 100 wppm to 1000 wppm of particles having a particle size of 0.1 μm to 25 μm;

or iv) 10 wppm to 10000 wppm of particles having a particle size of 0.1 μm to 25 μm.

4. The method of claim 1, wherein the hydroprocessed effluent comprises 50 wppm or less of particles having a particle size of 0.1 μm to 50 μm.

5. The method of claim 1, wherein the hydroprocessed effluent comprises 10 wppm to 100 wppm of particles having a particle size of 0.1 μm to 50 μm.

6. The method of claim 1, wherein the hydroprocessed effluent comprises 75 wt. % or less of particles having a particle size of 0.1 μm to 50 μm relative to the weight of particles in the reduced particle-size solids-containing fraction.

7. The method of claim 1, further comprising adding a solvent to the at least a portion of the solids rejection fraction prior to the exposing.

8. The method of claim 7, wherein the solvent comprises the utility fluid.

9. The method of claim 1, wherein the feedstock comprises 20 wt. % to 90 wt. % of the utility fluid.

10. The method of claim 1, wherein the solids rejection fraction comprises 1 wt. % to 25 wt. % of particles having a particle size of 50 μm to 1000 μm.

11. The method of claim 1, wherein the physical particle size reduction process comprises grinding, ablation, milling, or a combination thereof.

12. The method of claim 1, wherein the separating comprises centrifugation, settling, filtering, or a combination thereof.

13. The method of claim 1, wherein the hydroprocessing comprises fixed bed hydroprocessing, fluidized hydroprocessing, or a combination thereof.

14. The method of claim 1, wherein combining at least a recycle portion of the reduced particle-size solids-containing fraction with the solids rejection fraction prior to exposing the solids rejection fraction to the physical particle size reduction process comprises:

separating the recycle portion of the reduced particle-size solids containing fraction and a product portion of the reduced particle-size solids containing fraction from a remaining portion of the reduced particle-size solids containing fraction; and combining the product portion of the reduced particle-size solids containing fraction with at least one of the feedstock, the clarified feed fraction, and the at least a portion of the clarified feed fraction.

15. A method for processing a feedstock including at least a portion of a pyrolysis tar, comprising:

exposing a feedstock comprising a pyrolysis tar portion and a utility fluid, the feedstock comprising a first weight of particles having a particle size of 50 μm or more, to a physical particle reduction process to form a reduced particle size feedstock having a second weight of particles having a particle size of 50 μm or more, the second weight being 85% or less of the first weight;

separating a solids rejection fraction and a clarified feed fraction from the reduced particle-size feedstock, the solids rejection fraction comprising 60 wt. % or more of the particles having a particle size of 50 μm or more from the feedstock; and hydroprocessing at least a portion of the clarified feed fraction under solvent-assisted hydroprocessing conditions to form a hydroprocessed effluent, the clarified feed fraction comprising 10 wppm to 10000 wppm of particles having a particle size of 0.1 μm to 50 μm.

16. The method of claim 15, wherein the clarified feed fraction comprises i) 10 wppm to 150 wppm of particles having a particle size of 0.1 μm to 50 μm;

ii) 50 wppm to 500 wppm of particles having a particle size of 0.1 μm to 25 μm;

iii) 100 wppm to 1000 wppm of particles having a particle size of 0.1 μm to 50 μm;

or iv) 10 wppm to 10000 wppm of particles having a particle size of 0.1 μm to 25 μm.

17. The method of claim 15, wherein the hydroprocessed effluent comprises 50 wppm or less of particles having a particle size of 0.5 μm to 50 μm;

or wherein the hydroprocessed effluent comprises 75 wt. % or less of particles having a particle size of 0.1 μm to 50 μm relative to the weight of particles in the reduced particle-size solids-containing fraction.

18. The method of claim 15, wherein the feedstock comprises 20 wt. % to 90 wt. % of the utility fluid.

19. The method of claim 15, wherein the solids rejection fraction comprises 1 wt. % to 25 wt. % of particles having a particle size of 50 μm to 1000 μm.

20. The method of claim 15, wherein the physical particle size reduction process comprises grinding, ablation, milling, or a combination thereof.

21. The method of claim 15, wherein the separating comprises centrifugation, settling, filtering, or a combination thereof.

* * * * *